United States Patent [19]

Brandt et al.

[11] Patent Number: 4,543,068

[45] Date of Patent: Sep. 24, 1985

[54] INBOARD OUTBOARD DRIVE AND MOUNTING THEREFOR

[75] Inventors: Lennart Brandt, Fjärås, Heinz Pichl, Upsala, both of Sweden

[73] Assignee: Ab Volvo Penta, Gothenburg, Sweden

[21] Appl. No.: 461,962

[22] Filed: Jan. 28, 1983

[30] Foreign Application Priority Data

Feb. 3, 1982 [SE] Sweden ..... 8200604

[51] Int. Cl.[4] ..... B63H 5/12

[52] U.S. Cl. ..... 440/53; 440/112

[58] Field of Search ..... 440/49, 52, 53-65, 440/112

[56] References Cited

U.S. PATENT DOCUMENTS 1,689,962 10/1928 Peck ..... 440/59

3,057,320 10/1962 Daniels ..... 440/112

4,040,378 8/1977 Blanchard ..... 440/52

*Primary Examiner*—Jesus D. Sotelo

*Attorney, Agent, or Firm*—Arthur G. Yeager

[57] ABSTRACT

An inboard outboard drive is at the housing portion passing through the hull provided for sealing and damped support, with a resilient element with a non-collapsible cross-sectional shape which is subject to a constantly acting compressing force, conveniently generated by the weight of the engine. When cracks occur in the resilient element, the edges of the cracks are pressed together by this compressing force, whereby penetration of water into the hull is prevented or at least rendered more difficult. The invention is suited for application in inboard outboard drives of the S-type as well as of the Z-type.

21 Claims, 11 Drawing Figures

Fig. 6
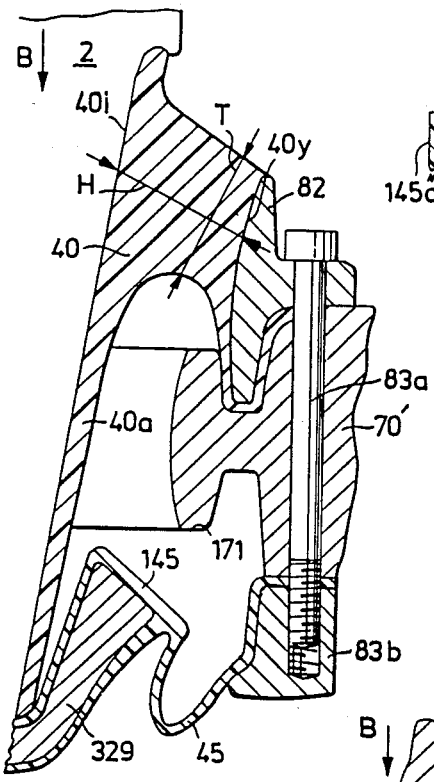
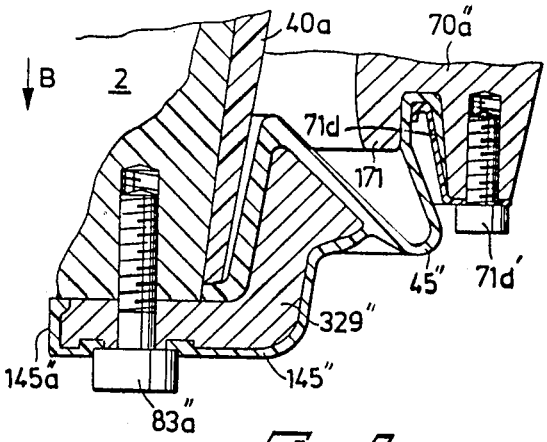
Fig. 8
Fig. 7
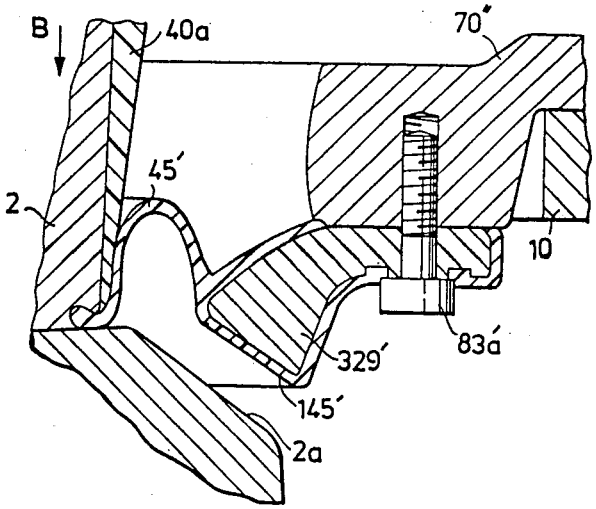

INBOARD OUTBOARD DRIVE AND MOUNTING THEREFOR

RELATED APPLICATIONS

This application is related to the applicant's related applications entitled:

INBOARD OUTBOARD DRIVE, U.S. Ser. No. 461,877, now U.S. Pat. No. 4,501,560; and

INBOARD OUTBOARD DRIVE AND MOUNTING SHIELD THEREFOR U.S. Ser. No. 461,876 now U.S. Pat. No. 4,478,585, both filed on Jan. 28, 1983.

FIELD OF INVENTION

This invention realtes to inboard outboard drives and particularly a mounting device thereon for supporting on and sealing to the hull a structural part or housing of the inboard outboard drive which passes through an opening in the shell of the hull of a boat.

DESCRIPTION OF THE PRIOR ART

Inboard outboard drives are known having an inboard engine, a structural part of propeller leg, generally a casing or housing extending from the engine through an opening in the shell of the hull. The engine is connected for the transmission of torque by shafting in the structural part to the propeller mounted on an outboard portion of the structural part.

Two types of inboard outboard drives have been made. In one type, the generally called Z-type, U.S. Pat. No. 3,626,467, Mazziott, patented Dec. 7, 1971, the substantially horizontal output shaft of the engine, or more precisely an extension thereof, passes through an opening in the transom of the hull and enters an upper angular gear box which is located in a vertical propeller leg positioned entirely outboard of the hull. The lower end of the propeller leg provides a propeller housing. The engine output shaft is connected by the upper angular gear box, a vertical shaft in the propeller leg and a lower angular gear box and horizontal propeller shaft in the propeller housing to drive the propeller.

In the other type, often used as an auxiliary motor in sailboats and therefore called an S-drive, the upper angular gear box is located inboard and the vertical propeller leg or lower unit lies partly inboard, passes through an opening in the bottom of the hull to support the outboard propeller housing portion. In a special instance, the upper angular gear box is omitted in an S-drive by mounting the engine part with the output shaft positioned vertically and the engine mounted directly on the lower unit.

SUMMARY OF THE INVENTION

An inboard outboard drive having an inboard engine connected by a structural part which passes through an opening in the hull and is supported on the hull. The structural part has an outboard propeller housing portion on which a propeller is mounted. Torque transmitting means on the structural part connects the engine to drive the propeller. The structural part is not firmly or rigidly fastened to the hull to avoid the transmission of vibrations and noise from the engine and propeller to the hull. The opening is therefore made somewhat larger than the outer dimension of the structural part casing, and the intermediate space is sealed by a resilient element, e.g. a rubber bellows sleeve or annular element.

It will be understood that the strength and reliability of the sealing element which seals the opening in the hull is an important parameter, particularly in S-drives, because there this element is continuously exposed to water pressure on the outside. The whole boat may be filled with water if in an S-drive for some reason a crack occurs in the sealing element, a rubber bellows or a rubber sleeve. Insurance companies and other institutions therefore have particularly exacting requirements for resilient sealing elements in S-drives.

It is an object of the present invention to provide an improved device for mounting an inboard outboard drive in the hull and by which security against leakage is obtained by employing a resilient vibration damping supporting and sealing element for supporting the inboard outboard drive and sealing the opening between the structural part the hull constructed to support the drive and being stressed to damp the transmission of vibration and noise to the hull and stressed to close any openings or cracks to prevent leakage.

Though, conventionally, the support of an inboard outboard drive in the hull is arranged quite independently from the sealing sleeve, according to a preferred embodiment of the invention the engine part constantly compresses with at least a portion of its weight the uncollapsible resilient element which seals the space between the propeller and the hull, so that the dges of a possible crack cannot be pressed apart by the water pressure and allow water to flow into the hull, but instead are automatically pressed together for sealing so that the damaged boat may reach, possibly with reduced speed, the nearest convenient anchoring place.

The resilient element may further, due to its thickness, be made of softer material than that which is conventional in sealing sleeves and sealing bellows, whereby a better damping of vibration is obtained. The arrangement is preferably complemented by a deflection limiter, i.e., a stop means which in a selected degree limits stretching of the resilient element when casually affected or loaded in a direction opposite to the direction of compression, whereby stretching of the element beyond a permitted limit is prevented. Such affecting or loading may occur e.g. when the propeller housing strikes an underwater obstacle or when the water level at the anchoring place falls so much that the propeller housing hits the bottom.

It will be understood that instead of the weight of the engine part also the weight of some other structural part, or a special weight provided to this purpose may be used to constantly compress the resilient element. Gravitational force may also be combined with, or quite replaced by, some other force, e.g. spring force or magnetic attraction, by arranging spring means or magnetic and armature means between the fixing means which support the resilient element at the opposite ends thereof.

The resilient element may further preferably be arranged in such a manner, than when driving in the sea also the pushing force of the propeller acts thereupon in compressive direction and so temporarily, but when most needed, augments the effect of the constantly operating force. Although the invention shows the greatest advantage when applied to inboard outboard drives of the S-type, it is likewise used in Z-drives, and examples thereof will be described below.

BRIEF DESCRIPTION OF THE DRAWINGS

The novel features which are believed to be characteristic of this invention are set forth with particularity in the appended claims. The invention itself, however, both as to its organization and method of opertion, together with further objects and advantages thereof, may best be understood by reference to the following description taken in connection with the accompanying schematic drawings, in which:

FIGS. 6, 7, 8, 9 and 10 are partial sectional views of five embodiments showing constructions of the resilient element and a deflection limiter according to the invention;

Structural parts with identical function are in all drawings figures denominated by identical or analogic reference signs. In the description of each figure reference is made to the prior description of identical and similar parts.

DESCRIPTION OF THE PREFERRED EMBODIMENTS

Figure 1:
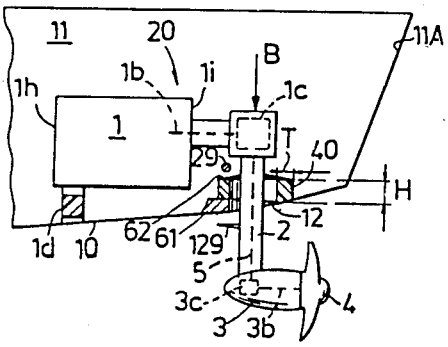
FIGS. 1, 2 and 3 are partial views of a boat, each having a different types of S-drive and showing first, second and third embodiments of the invention to explain the principles of the invention.

A hull 11 of a boat has according to FIG. 1 a bottom 10 and a transom 11A. The boat is provided with an inboard outboard drive 20 of the S-type with an engine part 1 and a lower unit 2 with a propeller housing part 3 which supports a propeller 4 mounted on a propeller shaft 3*b*. The lower unit 2 comprises an upper angular gear box 1*c* and a power transmission shaft 5, and in propeller housing part 3 thereof a lower angular gear box 3*c* is located. The engine part 1 is mounted with its output shaft 1*b* in horizontal position.

In the bottom 10 of hull 11, an opening 12 is arranged through which the lower unit 2 passes and which is somewhat larger than the cross-section of this lower unit. Around the periphery of the opening 12 a first fixing means 61 is provided which is fastened to the bottom 10 of hull 11. A second fixing means 62 is fastened to the lower unit 2 and spaced from first fixing means 61 in the direction inwards of hull 11. An annular resilient element 40 is sealingly supported in both fixing means. Element 40 is shown only schematically in FIGS. 1 and 2, and the present invention is by no means limited to the embodiment shown there.

The engine part 1 is at its end portion 1*h* which is remote from opening 12 mounted in the hull 11 in a resilient and vibration damping manner with the aid of two resilient blocks 1*d*, located side by side. No particular seating place is provided at the end portion 1*i* closest to opening 12, but engine part 1 is there via the upper portions of lower unit 2 supported by second fixing means 62 and affects through this means element 40 which is thus constantly affected by a compressing force B which in the example shown corresponds approximately to half the weight of engine part 1 plus that portion of the weight of lower unit 2 which is not compensated by the buoyance of water. The resilient element 40 is produced of conventional material, e.g. rubber, having a height H and the thickness T, and presents such a shape that will only get compressed, but will not buckle or collapse when affected by a compressive force.

The engine part 1 is in the example shown mounted according to applicant's three-point principle on the two resilient blocks or cushions 1*d*, located side by side, and on the element 40. A fixed stop 29 anchored in hull 11 as a deflection limiter, or a deflection limiter 129 provided on lower unit 2 or the propeller leg, limit the range of movement of the device or lower unit 2 in the direction inward of the hull, i.e. in the reverse direction of arrow B.

Figure 2:
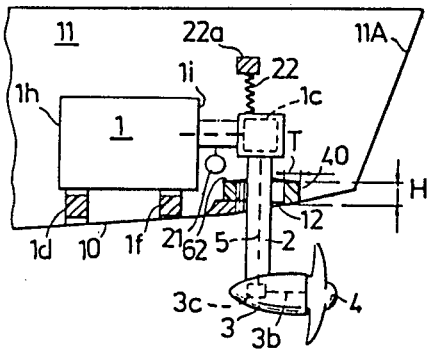

In FIG. 2 is shown another embodiment where the engine part 1 is mounted on four resilient blocks or cushions 1*d*, 1*f*, so that the weight thereof only to a limited extent, or not at all, affects resilient element 40. On this account, another generator of compression force is provided, such as a weight 21 and/or a compression spring 22 which is mounted between lower unit 2 and a mount 22*a* anchored in hull 11.

Figure 3:
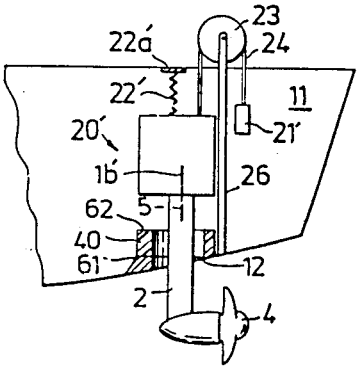

In FIG. 3 is shown the arrangement of an S-drive 10' where engine part 1 is mounted with its output shaft 1*b'* in vertical position on guide means 26 which is mounted on hull 11 for supporting engine part 1 in correct position without interfering with its vertical movement. The engine 1 applies, in this arrangement with all its weight, a force or load on resilient element 40.

In FIG. 3 is further shown that the compression force generated by engine part 1 also can be reduced, if need be, e.g. by an expansion spring 22' anchored to a mount 22*a'* and to engine part 1, and/or by a counter-weight 21' which affects engine part 1 via a cable 24 passing over a pulley wheel 23 rotatably mounted on guide means 26.

Figure 4:
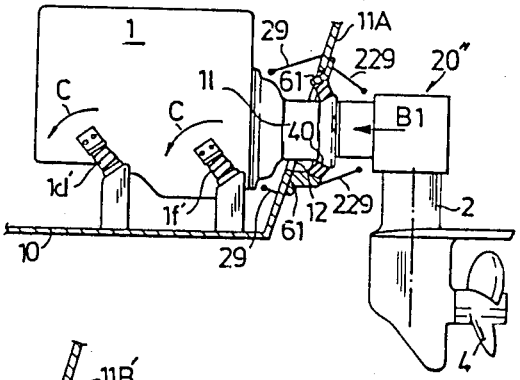
FIGS. 4 and 5 are partial sectional views of a boat, each having a different Z-drive and further embodiments of the invention.
Figure 5:
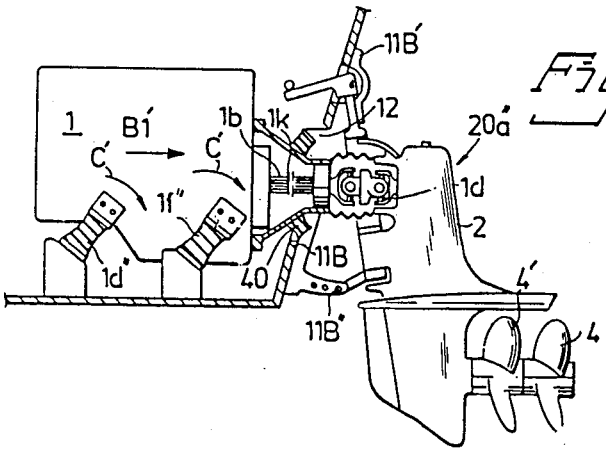

In FIGS. 4 and 5 the mounting device according to the invention is shown in Z-drives 20'' and 20''*a*. From the study of these drawing figures it will be evident that also in the operation of these mounting devices a portion of the weight of the engine part 1 affects or loads the resilient element 40 with a compression force which constantly compresses the element 40. While in an S-drive the structural part which passes outboard via the opening 12 in bottom 10 of hull 11 is lower unit 2 itself, in a Z-drive this is a link 1*l* which is a housing portion located between engine part 1 and lower unit 2 and which passes through opening 12 provided in the transom 11A.

According to FIG. 4, an inboard outboard drive 20'' of the Z-type comprises an engine part 1 which is mounted on four inclined resilient cushions 1*d'*, 1*f'* which with their upper ends slope forward in the driving direction, so that the engine part 1 has a tendency to move in the direction of arrows C, when a compression force in the direction of arrow $B_1$ affects the resilient element 40. When driving, the compressive effect is further increased by the propulsive force of the propeller 4. On this account the device is, besides of the earlier named limiter 29 restraining the stretch, also provided with a deflection limiter 229 which to a predetermined extent restrains the compression of the resilient element 40, e.g. on a flying start, when touching the bottom, etc.

According to FIG. 5, an inboard outboard drive 20'' of the Z-type, provided with a double propeller assembly 4, 4', is side-steerable, as shown in applicant's application U.S. Ser. No. 461,877, but otherwise fixedly mounted in a transom 11B to which the drive is attached at 11B' and 11B''. The drive is further provided with a double universal joint 1*d*. The engine part 1 is mounted in four sloping resilient cushions 1*d*'', 1*f*'' which are inclined backwards at their upper ends, so that the engine part 1 due to its weight has a tendency to move in the direction of arrows C' and a compression force in the sense of arrow $B_1$' acts upon the resilient element 40. Between the output shaft of engine part 1 and the shafting in lower unit 2, a spline joint 1K is provided which is shown for clarity with its connection sleeve removed and which compensates or permits the movement of engine part 1 in the sense of arrow $B_1$' in regard to the components of the drive which are carried by the transom 11B. The propulsive power of the propeller in this embodiment does not affect or load the resilient element 40.

Several examples of preferred specific embodiments of the resilient element according to the invention will now be shown in the following drawing figures.

According to FIG. 6, the resilient element 40, e.g. of rubber, is at its inner periphery 41*i* fixed to the outer perimeter of lower unit 2 and at is outer periphery 40*y*, which lies more forwardly in the direction of compression, to a bottom shield 70' fastened to the bottom 10 of the hull, and is there retained with the aid of an annular frame 82, retaining screws 83*a*, and a second annular frame 83*b*. With the resilient element 40 (having a thickness in the order of magnitude of 2 cm) is associated an integral covering 40*a* for a portion of the lower unit 2, which thus is protected from corrosion and the like. This protection is further complemented by a considerably thinner sealing membrane 45 which from the outboard side shields the resilient element 40 and thus protects the underside thereof against being covered by mussels and the like and against sand being able to come through and damage the surface of the resilient element. The membrane 45 confers at the same time further security against leakage.

It has been stated above that for good damping of vibrations it is advantageous when the resilient element can be made of soft material. This may, however, entail that the engine jerks at start and, e.g. when driving in agitated sea moves, so that the resilient element exercises a too strong spring effect. Therefore, a deflection limiter is conveniently provided which eliminates this risk, e.g. an annular deflection limiter 329 which is made of metal, fastened to the lower unit 2, and covered by a resilient cover 145, which is advantageously integral with the sealing membrane 45. The shield 70' is at its lower inner periphery provided with a land surface 171 against which the deflection limiter 329 bumps when extremely affected in the reverse sense of arrow B.

In FIGS. 7 and 8 are shown examples of two further preferred embodiments of annular deflection limiters which are arranged closely adjacent the resilient element 40. According to FIG. 7, an annular deflection limiter 329' made of metal is provided with a resilient cover 145' integral with the sealing membrane 45', and is fastened to a shield 70''. Owing to the cover 145', the shocks arising upon engagement of the limiter 329', i.e. when it bumps onto an opposite land surface 2*a* on the lower unit 2 are damped. The deflection limiter 329' is at its outer periphery, and together with the membrane 145', by retaining screws 83*a*' fixed to the bottom shield 70'' which in its turn is fastened to the bottom 10 of the hull.

According to FIG. 8, an annular deflection limiter 329'' is at its inner periphery fixed to the lower unit 2 by retaining screws 83*a*'' and is covered by a resilient covering 145'' which is integral with the sealing membrane 45''. The innermost portion of the covering defines a packing ring 145*a*'' with regard to the lower unit 2. The sealing membrane 45'' in its turn is with the aid of a rigid frame 71*d* and of retaining screws 71*d*' fixed to a bottom shield 70''*a* which has a land surface 171 for the deflection limiter 329'' and which, in a manner not shown, is attached to the bottom 10 of hull 11 (FIG. 1).

The resilient cover according to FIGS. 6 to 8 protects the deflection limiter against corrosion, so that the limiter may be made e.g. of metal sheet which is not protected against rust. According to FIGS. 9 and 10, which essentially is like FIGS. 5 and 6 of applicant's copending application U.S. Ser. No. 461,876, the outer perimeter of lower unit 2 is attached to inner periphery of resilient element 40. The outermost peripheric portion 40PP of resilient element 40 is with the aid of screw bolts 171C or 171C' affixed to the outer peripheric portion of the bottom shield 70''', and together therewith, with the aid of nuts 171*b*, to a bedding 11C' provided in the bottom of the hull. The resilient element 40 is further supported in a shallow groove 71*b*' in the bottom shield 70''' and due to said screw fixation the groove 71*b*' has essentially only the function of taking up pressure stress by its bottom surface. A bracing element 131 defined by a rigid. e.g. metal ring with a bed profile, extends radially inwardly centrally inside resilient means 40 from their outer periphery. Adjacent the outer face of resilient means 40 which in the drawing lies upward, is a peripheric cap 231, also rigid, which has a somewhat more outward and upwards bend profile and the resilient element 40. Bracing element 131, cap 231 and an annular packing 13 are attached with the aid of the same screws 171C as the resilient means 40 and the bottom shield 70'''.

The bracing element 131, as well as the cap 231 (which conveniently also can be made of metal) may act as deflection limiting means for the elastic resilient element 40. The cap 231 has at its inner portion substantially the shape of a spherical segment cut-off by two parallel planes. Due to this shape, cap 231 acts not only as a deflection limiter in axial direction (in the reverse direction of arrow B), but also in all directions which are radial in regard of arrow B, whereby maximum stability of the device is obtained also at extreme stress in any arbitrary direction.

It will be observed that the inner peripheric portion 231' of the peripheric cap 231 overlaps a protruding flange portion 2' of the lower unit 2, and that a thin flange portion 40' of the resilient element 40 extends therebetween as a shock-absorber.

Figure 9:
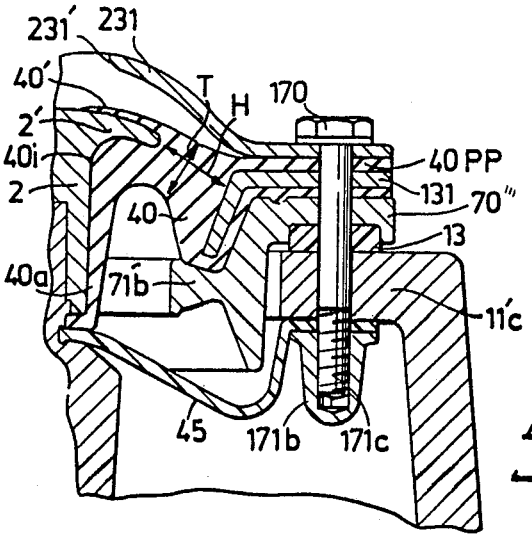
Figure 10:
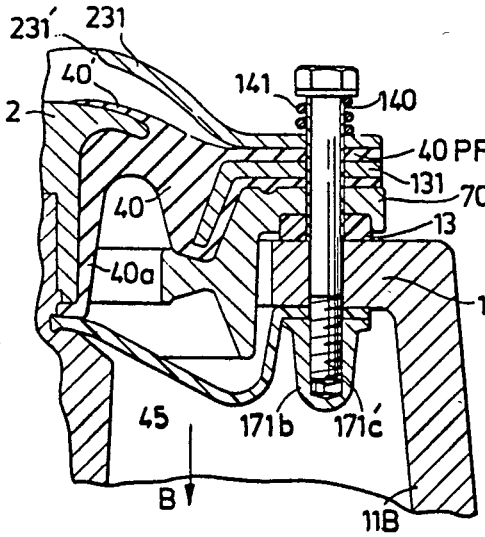

The device of FIG. 10 differs from the device of FIG. 9 in that the retaining screws 171*c* are longer and protrude from the cap 231. They have sleeves 140 slipped on which transmit pressure from the heads of the screws 171*c*' to the shield 70''' whereby the screws 171*c*' upon tightening of the nuts 171*b* are firmly anchored in the bedding 11C'. On the protruding portions of the screws 171*c*' are strong helical springs 141 slipped on which rest on the one end against the heads of the screws, and on the other end against the cap 231. Thereby are all parts through which the screws 171*c*' pass, i.e. the packing 13, the shield 70''', the resilient element 40, the bracer element 131, and the peripheric cap 231 subject to strong, but elastic pressure.

The purpose of this arrangement is to automatically compensate the setting, principally of the resilient structural parts which are fastened by the screws 171*c*'.

Figure 11:
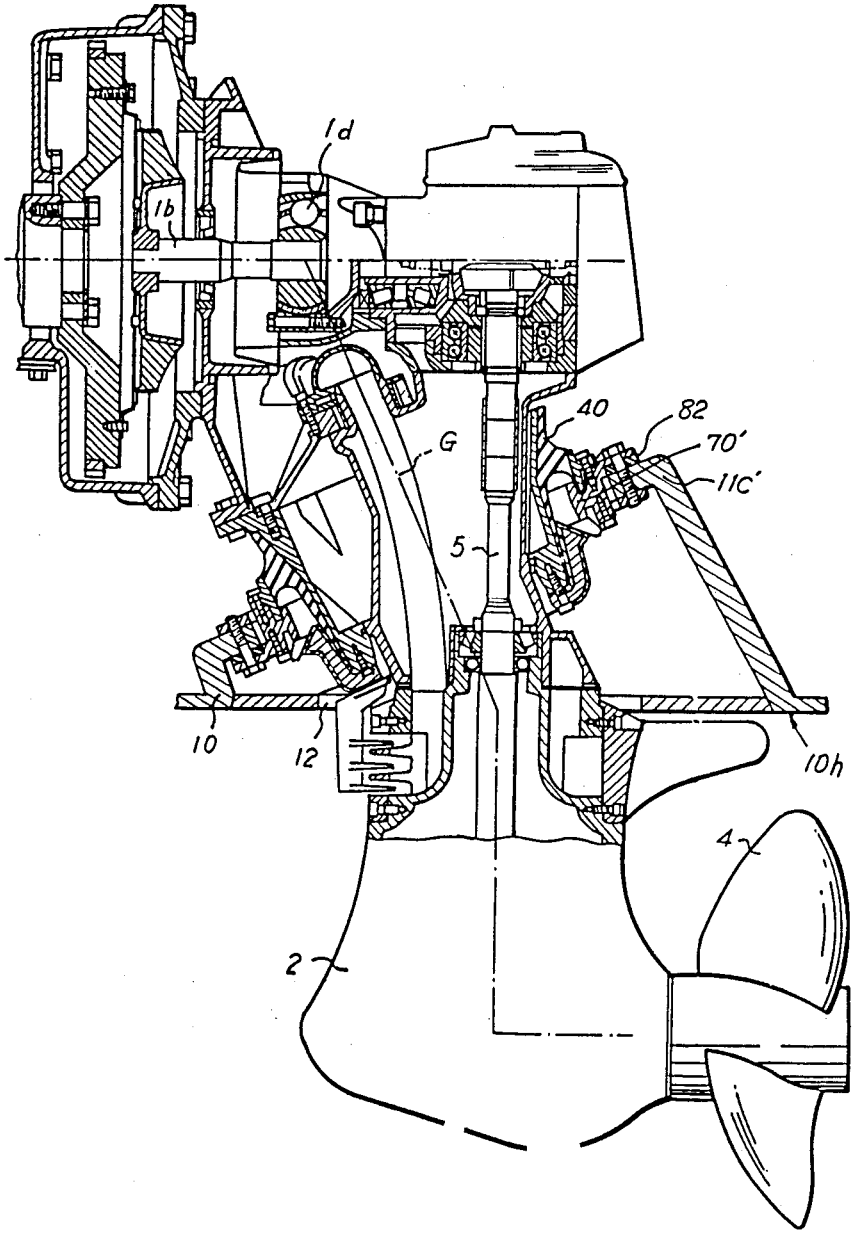
FIG. 11 is a side view with parts broken away and in axial section of an S-drive according to the invention on a reduced scale compared to FIGS. 6 to 10.

FIG. 11 shows on a smaller scale an axial cross-section through an inboard outboard drive of the S-type according to the invention, which is provided with a resilient element 40 according to FIG. 6 and which is side steerable around an inclined steering axis G. This inclined steering axis G passes through the universal joint 1*d* owing to the fact that the bottom shield 70', in which the resilient element 40 is inserted is attached to a bedding 11C', inclined as necessary so the steering bearing provides pivotal movement on the steering axis and is mounted on the bottom of the hull.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An inboard outboard drive for use in a boat having a hull with an opening therein, comprising an engine mounted inboard in the hull and structural means including a housing which passes through said opening with a peripheral space for free motion, a lower unit located at least partially outboard, a lower angular gear box on the lower portion of said lower unit, a propeller mounted for rotation on the lower portion of said lower unit and power transmission drive train means between the engine and propeller which includes said lower angular gear box for driving said propeller; an annular resilient element extending around said housing and the periphery of said opening to seal said peripheral space, mounting means on said hull for supporting said inboard outboard drive on said hull including first engaging means on said housing and second engaging means on said hull engaging opposite end of the height of the profile of said resilient element which has a profile which owing to the relation of its height to the thickness transverse to the height prevents buckling out or collapse, and providing a force on said inboard outboard drive to constantly subject said resilient element to a compressing force to close any crack in said resilient element to prevent or reduce leakage, said housing being a portion of said lower unit having said first engaging means, said annular resilient element having an inner periphery mounted on said first engaging means on said lower unit and an outer periphery more forward in the direction of said compressing force mounted on said second engaging means provided by an annular mounting shield affixed and sealed to said resilient element and fixed and sealed to said hull around the opening.

2. The invention defined in claim 1 and wherein in said mounting means said compressing force is generated by a part the weight of which in predetermined degree acts upon said resilient element.

3. The invention defined in claim 1 and wherein in said mounting means said compressing force is generated by the engine and loads in a predetermined degree said resilient element with the weight of said engine.

4. The invention defined in claim 3 and wherein said compressing force of said mounting means is augmented by the effect of the propulsive force of said propeller when driving.

5. The invention defined in claim 1 and wherein said mounting means providing said compressing force is in response to the weight of parts of said inboard outboard drive, and further comprising additional means to modify said compressing force on said resilient element.

6. The invention defined in claim 1 further comprising deflection limiting means mounted for cooperation between said inboard outboard drive and hull for limiting in at least one direction the deformation movement of said resilient element.

7. The invention defined in claim 6 and wherein said mounting means comprises engine mounting means including at least one resilient cushion at the fore end of the engine in the direction of drive and engaging the hull and the engine means at its rear end mounted by said structural means and resilient means in the hull.

8. The invention defined in claim 6 the opening being in the transom of the hull and said inboard outboard drive being of the Z-type, said engine being rigidly attached at its rear end to said lower unit, in said mounting means said engine is mounted on resilient cushions which at their upper end slope forwardly in the direction of driving and that a portion of said lower unit extends horizontally through the opening in the transom and said engaging means compresses said resilient means in an inboard direction.

9. The invention defined in claim 8 and further comprising deflection limiting means mounted between said inboard outboard drive and the hull for limiting the common movement of said engine and said lower unit in at least one of the senses of forward and backward relative to the normal driving direction.

10. The invention defined in claim 1 the opening being in the transom of the hull and said inboard outboard drive being of the Z-type, said structural means has a portion rigidly mounted on the transom for supporting said lower unit and transmitting drive thrust to said hull, said mounting means having resilient cushions mounted in the hull and extending upwardly and inclined backward opposite the driving direction for supporting said engine and providing a compressing force in a backward and outboard direction, said resilient element being compressed by said engaging means by said compression force in an outboard direction.

11. The invention defined in claim 1 and further comprising a sealing membrane sealed to said structural means and the hull to seal said peripheral space on the outboard side of said resilient element.

12. The invention defined in claim 1 and wherein said resilient element has a protective covering and surrounding a portion of said lower unit outboard of said resilient element.

13. The invention defined in claim 12 and wherein said deflection limiting means comprises an annular deflection limiting element on said lower unit and an opposite land surface on said mounting shield and a resilient covering means is mounted between said deflection limiting element and said land surface for shock absorption.

14. The invention defined in claim 13 and wherein said deflection limiting element being defined by a peripheric cap with a substantially spherical surface for limitation of deflections in axial and even in radial directions.

15. The invention defined in claim 14 further comprising an annular bracing means located centrally in the outer peripheral portion of said resilient element.

16. The invention defined in claim 15 further comprising fastening screws for fastening parts including said resilient element, said annular bracing means, said peripheric cap and said mounting shield to said hull and compression spring means on said fastening screws for providing constant pressure acting on such fastened parts.

17. An inboard outboard drive for use in a boat having a hull with an opening therein, comprising an engine mounted inboard in the hull and structural means including a housing which passes through said opening with a peripheral space for free motion, a lower unit located at least partially outboard, a propeller mounted for rotation on the lower portion of said lower unit and power transmission drive train means between the engine and propeller; an annular resilient element extending around said housing and the periphery of said opening to support in a vibration damping manner said housing and to seal said peripheral space, first engaging means on said housing and second engaging means on said hull engaging said resilient element at opposite ends of its cross-section which owing to the relation of its height to the thickness prevents buckling out or collapse upon compression, said housing being a portion of said lower unit having said first engaging means, said annular resilient element having an inner periphery mounted on said first engaging means on said lower unit and an outer periphery more forward in the direction of a compressing force mounted on said second engaging means, said inner and outer peripheries of said resilient element being free to move relative one another in said direction of said compressing force and in a direction reverse thereto.

18. The invention defined in claim 17 further comprising deflection limiting means mounted for cooperation between said inboard outboard drive and hull for limiting in at least one direction the deformation movement of said resilient element.

19. The invention defined in claim 17 and further comprising a sealing membrane sealed to said structural means and the hull to seal said peripheral space on the outboard side of said resilient element.

20. The invention defined in claim 17 and wherein said resilient element has a protective covering and surrounding a portion of said lower unit outboard of said resilient element.

21. The invention defined in claim 20 and wherein said deflection limiting means comprises an annular deflection limiting element on said lower unit cooperating with an opposite land surface and a resilient covering means is mounted between said deflection limiting element and said land surface for shock absorption.

* * * * *